US005649265A

United States Patent [19]

Tabuchi

[11] Patent Number: 5,649,265

[45] Date of Patent: Jul. 15, 1997

[54] IMAGE FORMING APPARATUS AND METHOD HAVING A TEMPERATURE SENSOR WHICH IS USED IN BOTH CONTACT AND SEPARATION POSITIONS

[75] Inventor: Takeshi Tabuchi, Kawaguchi, Japan

[73] Assignee: Ricoh Company, Ltd., Tokyo, Japan

[21] Appl. No.: 537,441

[22] Filed: Oct. 2, 1995

[30] Foreign Application Priority Data

Sep. 30, 1994 [JP] Japan ..... 6-236598

[51] Int. Cl.[6] ..... G03G 21/00; G03G 15/02

[52] U.S. Cl. ..... 399/44; 399/50; 399/66

[58] Field of Search ..... 355/203, 208, 355/219, 274; 361/220, 221, 225

[56] References Cited

U.S. PATENT DOCUMENTS 5,479,243 12/1995 Kurokawa et al. ..... 355/219

FOREIGN PATENT DOCUMENTS 4-316064 11/1992 Japan ..... 355/219

*Primary Examiner*—William J. Royer

*Attorney, Agent, or Firm*—Oblon, Spivak, McClelland, Maier & Neustadt, P.C.

[57] ABSTRACT

An image forming method and apparatus having a temperature sensor which moves into and out of contact with the surface of a charge roller contacting the photoconductive drum. When a copying operation is occurring and a voltage is applied to the charge roller, the air temperature surrounding the charge roller is detected and when the copy machine is idle and a voltage is not being applied to the charge roller, the temperature sensor moves into contact with the surface of the charge roller and the surface of the charge roller is detected. A voltage is applied to the charge roller depending upon the detected temperature. The temperature sensor may also be used to detect the temperature of a contact transfer roller or belt.

20 Claims, 12 Drawing Sheets

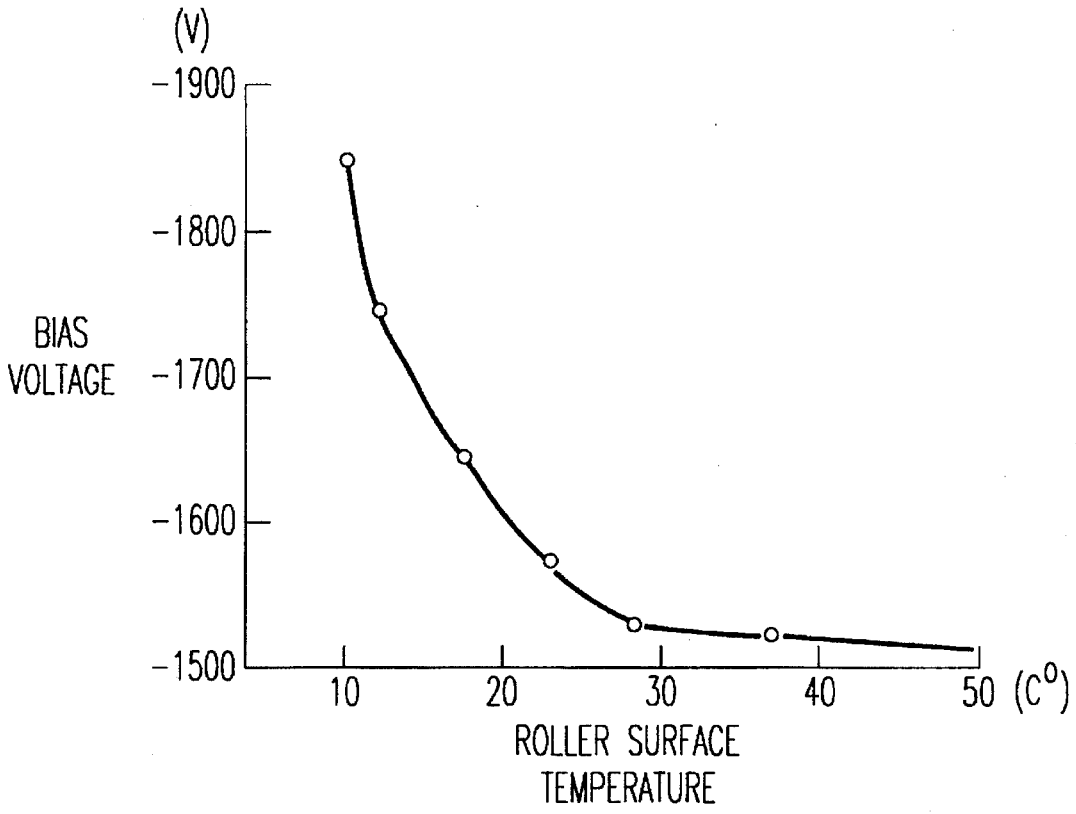
Fig. 6
Fig. 7
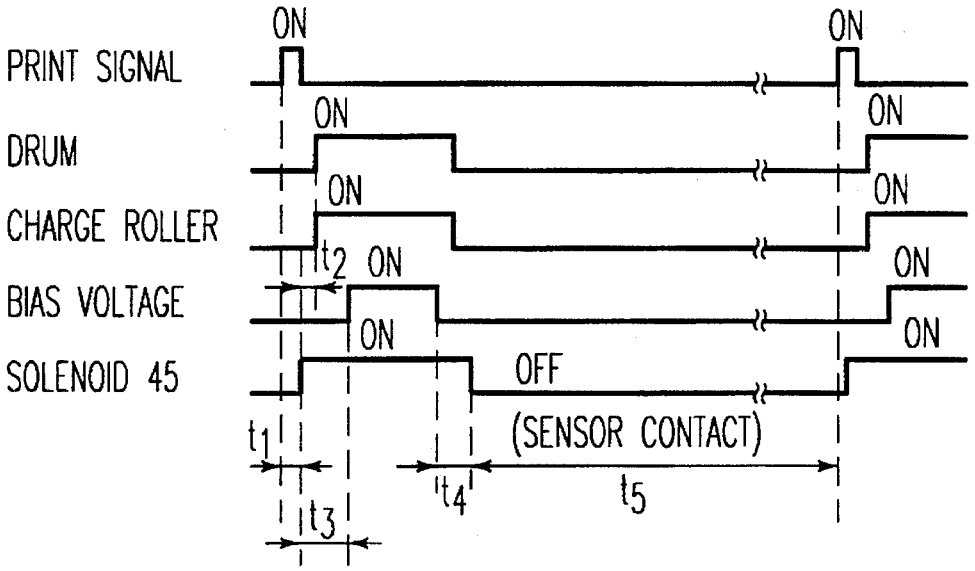

IMAGE FORMING APPARATUS AND METHOD HAVING A TEMPERATURE SENSOR WHICH IS USED IN BOTH CONTACT AND SEPARATION POSITIONS

CROSS-REFERENCES TO RELATED APPLICATIONS

This application is related to commonly owned, copending application 08/338,176 filed Nov. 9, 1994, entitled "IMAGE FORMING APPARATUS WITH A CONTACT MEMBER CONTACTING AN IMAGE CARRIER", which is incorporated herein by reference.

BACKGROUND OF THE INVENTION

1. Field of the Invention

The present invention relates to an electrophotographic image forming apparatus having a charging roller, image transfer member or similar contact member which is applied with a voltage in contact with a photoconductive element or similar image carrier, with or without the intermediary of paper. The present invention further relates to the use of a temperature sensor which is used in both contact and separation positions relative to an object whose temperature is being detected.

2. Discussion of the Background

Generally, an image forming apparatus of the type described, e.g., a facsimile apparatus or a printer includes a charging device for charging a photoconductive element or image carrier, and an image transfer device for transferring a toner image from the photoconductive element to a piece of paper. The charging device and image transfer device have often been implemented by a corona discharger having a discharge wire made of tungsten and not contacting the object to be charged. The charging device implemented by a corona discharger has the following problems.

(1) A voltage as high as 4 kV to 8 kV has to be applied to the discharge wire in order to deposit a charge potential of 500 V to 800 V on the photoconductive element, (2) Since most of the current from the discharge wire flows into a shield, only several percent of the total discharge current is available for charging the surface of the photoconductive element to the predetermined potential, obstructing efficient use of power.

(3) Corona discharge ionizes the air and generates a great amount of ozone, nitrogen oxides and other harmful substances. To prevent such substances from deteriorating the parts of the apparatus and the surface of the photoconductive element, the apparatus has to be provided with an ozone filter, a fan for generating a stream of air, etc.

(4) Images are apt to become irregular due to the contamination of the discharge wire.

In light of the above, there has been proposed a charging device having a charge roller or similar charging member which charges the photoconductive element in contact therewith when applied with a voltage. Such a contact type charging device is advantageous over the above-stated non-contact type device, as follows. The device reduces the voltage necessary for the predetermined charge potential to be deposited on the surface of the photoconductive element. The device produces a minimum of ozone during the course of charging and, therefore, eliminates the need for an ozone filter while simplifying an exhaust arrangement.

However, the problem with the contact-type charging device is that the charging efficiency, i.e., a ratio of the charge potential to the applied voltage, changes with a change in the surface temperature of the charge roller; the former decreases with a decrease in the latter. It follows that in the case of constant voltage control, a decrease in charging efficiency lowers the charge potential and, therefore, image density for a given applied voltage. In addition, the other process control, also using the charge potential as a reference value, becomes faulty.

To eliminate the above problems, Japanese Patent Laid-Open Publication No. 4-6567, for example, proposes an arrangement wherein the charge roller or similar charging member itself is heated to 35° C. to 55° C. so as to obviate defective charging even in a low temperature environment. To heat the charging member, a heat source is disposed in or in the vicinity of the charge member, or heat from a fixing device is fed to the charging member. For temperature adjustment, use is made of a thermostat or similar conventional temperature adjusting member.

By so controlling the temperature of the charge roller or similar contact member contacting the photoconductive element, it is possible to maintain a charge potential which does not degrade images. However, the heat heats not only the charging member but also the photoconductive element and other process units adjoining the heat source. As a result, toner collected from the photoconductive element after the image transfer is heated while it is returned to a developing device. This brings about so-called toner blocking and aggravates the cohesion of toner.

Japanese Patent Laid-Open Publication No. 4-186381, for example, teaches an improved charging device having a temperature sensor directly contacting the charge roller. In response to the output of the temperature sensor representing the surface temperature of the charge roller, the voltage to be applied to the roller is controlled to deposit a stable charge potential on the photoconductive element. This successfully eliminates the problems discussed above in relation to Laid-Open Publication No. 4-6567. In addition, since the temperature sensor directly contacts the charge roller, it can sense the surface temperature without regard to the ambient atmospheric temperature and, therefore, insures an adequate voltage.

However, even the charging device using a temperature sensor as stated above has some problems yet to be solved, as follows. Although the contact type charging scheme reduces the voltage required of the charge roller, compared to the non-contact type scheme using a corona discharger, a voltage as high as 1 kV to 2 kV is still necessary and affects the temperature sensor and other constituents in various ways.

For example, when such a high voltage is applied to the charge roller, electric noise is apt to enter a control circuit, which controls the voltage to the charge roller, via the sensor contacting the charge roller. Moreover, short-circuiting is apt to occur due to a small breakdown voltage. This causes the control system to malfunction or, in the worst case, breaks it. Further, the sensor contacting the charge roller causes the roller to wear, causes toner and paper dust and other impurities to adhere to the roller, and produces noise while the charge roller rotates in contact with the sensor. Although these problems may be eliminated if the sensor is spaced apart from the charge roller, then the sensor fails to sense the surface temperature of the roller with accuracy.

The foregoing description has concentrated on a charge roller which is applied with a voltage in contact with a photoconductive element. However, it is also true with an image transfer roller which is applied with a voltage in contact with a photoconductive element with the intermediary of a paper. Specifically, in the case of constant voltage control, if the surface temperature of the image transfer member is low, a toner image cannot be efficiently transferred from the photoconductive element to the paper.

SUMMARY OF THE INVENTION

It is, therefore, an object of the present invention to provide an image forming apparatus having a charging member, image transfer member or similar contact member contacting an image carrier and insuring a desired charge potential or image transfer potential even when applied with a voltage in a relatively low temperature environment.

It is another object of the present invention to provide an image forming apparatus having a contact member of the kind mentioned which frees a control system from malfunctions and breakage when applied with a voltage.

It is another object of the present, invention to provide an image forming apparatus having a contact member of the kind mentioned which prevents toner and impurities, including paper dust, from adhering to the surface thereof and does not produce noise due to rubbing.

It is another object of the present invention to provide an image forming apparatus having a contact member of the kind mentioned which obviates toner blocking and prevents the cohesion of toner from being aggravated.

It is another object of the present invention to provide an image forming apparatus which prevents, for example, a temperature sensor from causing the surface of a contact member of the kind mentioned to wear or break.

It is yet another object of the invention to use the temperature sensor both in a contact position and a separation position, relative to the device whose temperature is being sensed.

In accordance with the present invention, an image forming apparatus has a photoconductive element, a contact member applied with a voltage in contact with the photoconductive element, a voltage source for applying the voltage to the contact member, a temperature sensor for sensing the surface temperature of the contact member, a controller for controlling the voltage to be applied from the voltage source to the contact member in response to the output of the temperature sensor, and a moving mechanism for selectively moving the temperature sensor to a contact position where it contacts the surface of the contact member or to a non-contact position where it does not contact the contact member.

Before a first copy is made, the temperature sensor contacts the surface of contact member to determine the temperature of the contact member. The temperature sensor is then moved away from the contact member and a voltage is applied to the contact member based on the detected surface temperature and the copying operation is performed. If successive copies are made, the voltage is applied to the contact member based on a detected air temperature which is determined when the temperature sensor is separated from the contact member. The contact member is preferably a charging roller or a contact transfer roller or belt but the invention is also applicable to other elements and devices.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 6 is a graph of a relation between a bias voltage applied to a charge roller depending on the surface temperature of the roller;

FIG. 7 is a timing chart demonstrating the operation of the invention;

DESCRIPTION OF THE PREFERRED EMBODIMENTS

Figure 1:
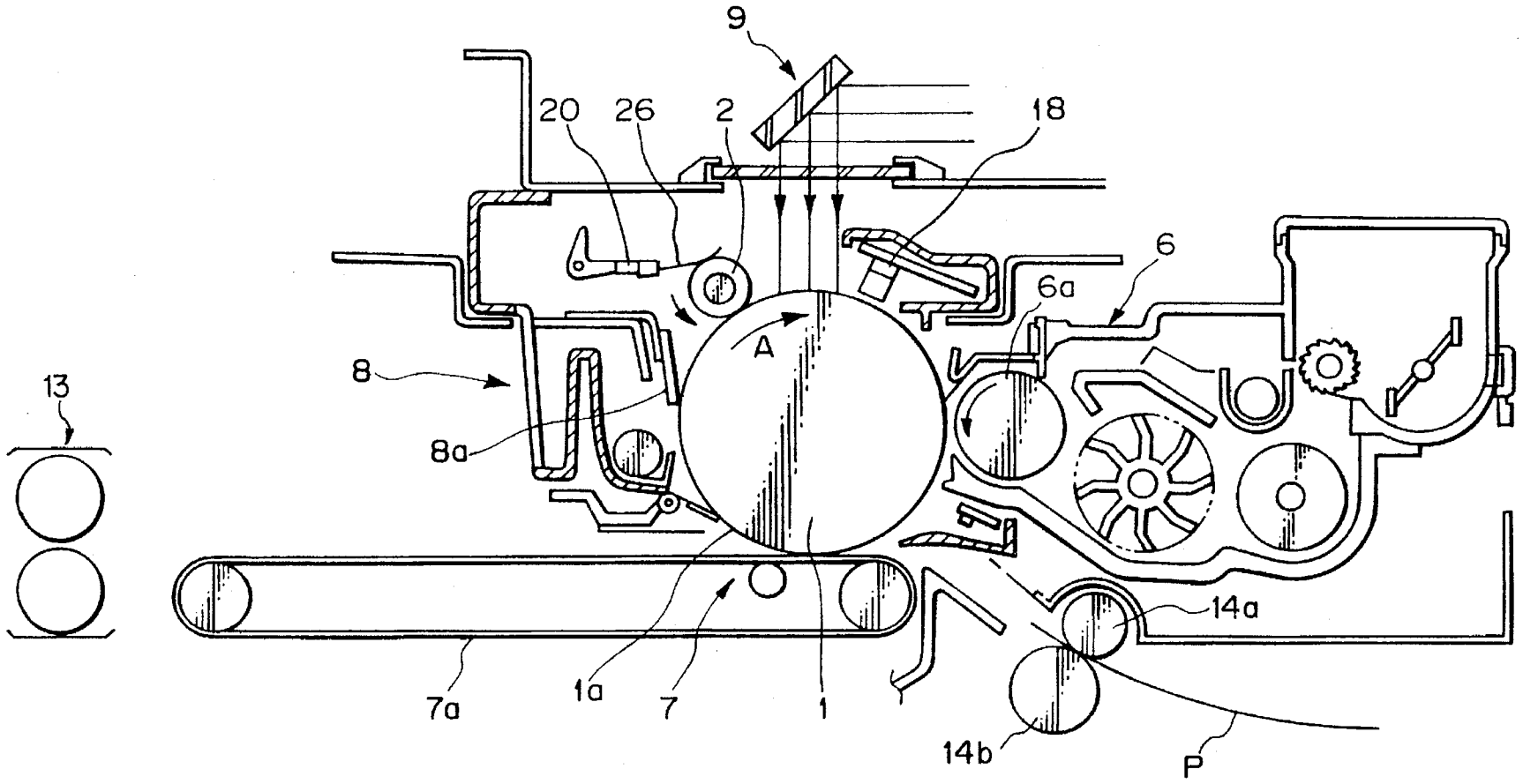
FIG. 1 is a cross-sectional view of the mechanical elements of an image forming apparatus according to the present invention.

Referring now to the drawings, wherein like reference numerals illustrate identical or corresponding parts throughout the several views and more particularly to FIG. 1 thereof, there is illustrated an image forming apparatus having an image carrier implemented as a photoconductive element 1 byway of example. A charge roller, or charging member 2 is constantly held in contact with the drum 1. A voltage is applied to the charge roller 2 to cause it to charge the surface 1*a* of the drum 1 uniformly to a predetermined potential. While the drum 1 is rotated at a proselected peripheral speed in a direction A, the charge roller 2 is driven by the drum 1 at the same speed as the drum 1 and in the same direction at the position where the former contacts the latter. The drum 1 is driven by a drum driveline, not shown, including a timing belt, drive pulley and motor for driving them. The charge roller 2 is pressed against the drum surface 1*a* by a spring, not illustrated, at a pressure of, for example, 10 g/cm (substantially line-to-line contact). Arranged around the drum 1 are, in addition to the charge roller 2, an eraser 18, a developing unit 6, a contact type image transfer unit 7 having an endless belt 7*a* which is held in contact with the drum 2 like the charger roller 2, and a cleaning unit 8.

Imagewise light issuing from optics 9 (only a mirror is shown) is incident to the uniformly charged surface 1*a* of the drum 1, thereby electrostatically forming a latent image. The eraser 18 trims the latent image, i.e., removes the electrostatic charge of the drum surface 1*a* outside of the size of a piece of paper P used. The latent image left on the drum surface 1*a* is developed by toner deposited thereon by a developing sleeve 6*a* included in the developing unit 6. As a result, the latent image is converted to a corresponding toner image.

The paper P is fed from a cassette, not shown, by a pick-up roller which is driven at a predetermined timing. A registration roller 14*a* and a press roller 14*b* rotatable in contact with the roller 14*a* stop once the paper P is fed from the cassette. Subsequently, the rollers 14*a* and 14*b* drive the paper P toward the image transfer unit 7, or image transfer position, such that the paper P accurately meets the toner image produced on the drum 1. The image transfer unit 7, applied with a bias, transfers the toner image from the drum 1 to the upper surface of the paper P, as viewed in FIG. 1. The paper P carrying the toner image thereon is separated from the drum 1 and then conveyed to a fixing unit 13. After the fixing unit 13 has fixed the toner image on the paper P, the paper P is driven out of the apparatus to, for example, a copy tray. After the image transfer, the toner and impurities, including paper dust, left on the drum 1 are removed by a cleaning blade 8*a* included in the cleaning unit 8. Further, the potentials left on the drum 1 are dissipated by a discharger, not shown, so as to prepare the drum 1 for the next uniform charging by the charge roller 2.

Figure 2:
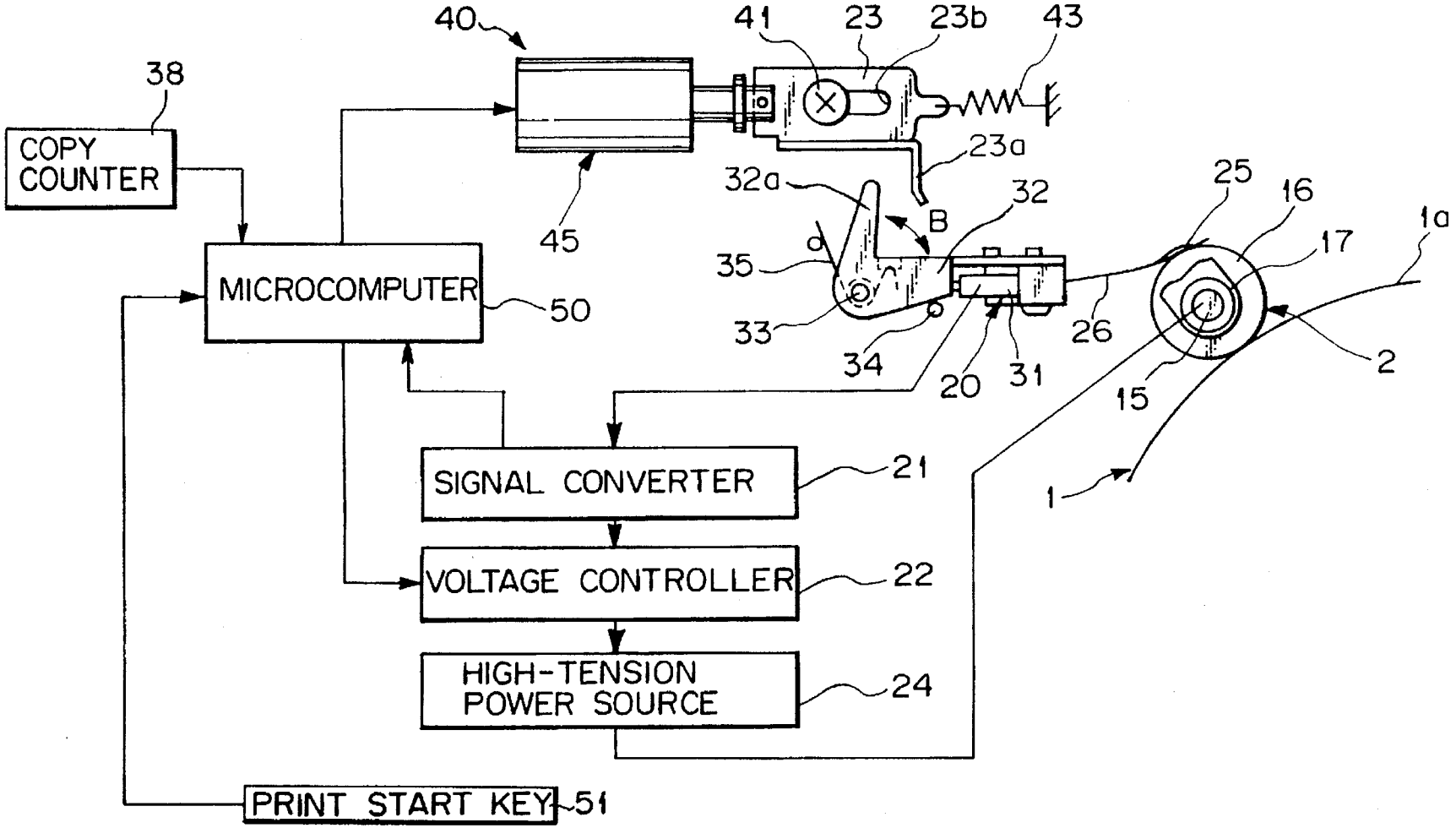
FIG. 2 is a view showing a photoconductive element, a charge roller contacting the element, and a temperature sensor included in the embodiment together with a control system.

As shown in FIG. 2, the charge roller 2 is made up of a core 15 made of iron or similar conductive metal, and a roller 16 covering the core 15 and made of EPDM (ternary copolymer of ethylene propylene dien or similar conductive rubber. The core 15 is rotatably supported by bearings 17 at opposite ends thereof. The bearings 17 are each biased toward the drum 1 by a spring (not illustrated) via a member which retains the bearings 17. In this configuration, the charge roller 2 is held in contact with the drum surface 1*a* with the axis thereof extending parallel to that of the drum 1. A high-tension power source 24 applies a bias voltage to the core 15, so that the drum surface 1*a* is uniformly charged. As shown in FIG. 6, the bias voltage applied to the core 15 changes with a change in the surface temperature of the charge roller 2.

A temperature sensor 20 is responsive to the surface temperature of the charge roller 2 and implemented by a thermistor or other temperature sensing means. The temperature sensor 20 includes a sensing element 25 contacting the charge roller 2. As the electric resistance of the sensing element 25 changes in response to the temperature of the charge roller 2, a signal converter 21 reads it by converting it to a voltage or similar electric signal. A voltage controller or voltage control means 22 controls the voltage to be applied from the power source 24 to the charge roller 2 in response to the output of the signal converter 21. Specifically, in response to the output of the signal converter 21, the voltage controller 22 looks up a preselected control table (see FIG. 6) to determine a correction amount with respect to a reference voltage. Then, the voltage controller 22 delivers a signal to the power source 24 for causing it to apply a bias voltage with the correction amount to the charge roller 2.

A microcomputer 50 Which controls the image forming apparatus has a CPU (Central Process Unit) for performing various kinds of decisions and processings, a ROM (Read Only Memory) or program memory storing various kinds of programs and fixed data necessary for various operations to occur at respective timings, a RAM (Random Access Memory) available for storing input data and output data from the CPU, and an I/O (Input/Output) circuit. A print start key 51 is used to start the copying operation and the copy counter 38 counts the number of copies made after the copy operation is started. This copy number is used to control the position of the temperature sensor 20 relative to the charge roller 2. As explained below with respect to the flowchart illustrated in FIG. 8, the temperature sensor contacts the charge roller before the first copy is made and is separated from the charge roller once the copy operation begins.

Figure 3:
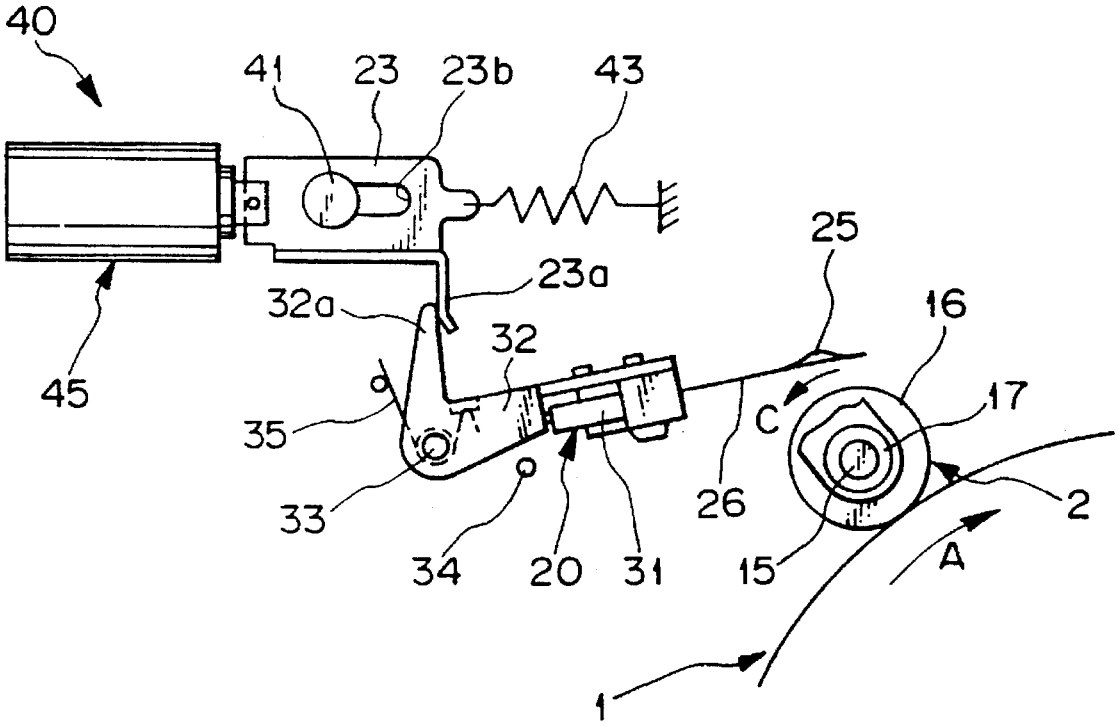
FIG. 3 shows the temperature sensor moved to a separation position.

FIG. 3 illustrates the sensing element 25 of the temperature sensor 20 in the non-contact or separation position, relative to the charge roller 2. In this position, the sensing element detects the air temperature surrounding the surface of the charge roller 2 and not the surface temperature of the charge roller 2. In the separation position, the sensor is 3 mm away from the charge roller, for example.

Figure 4:
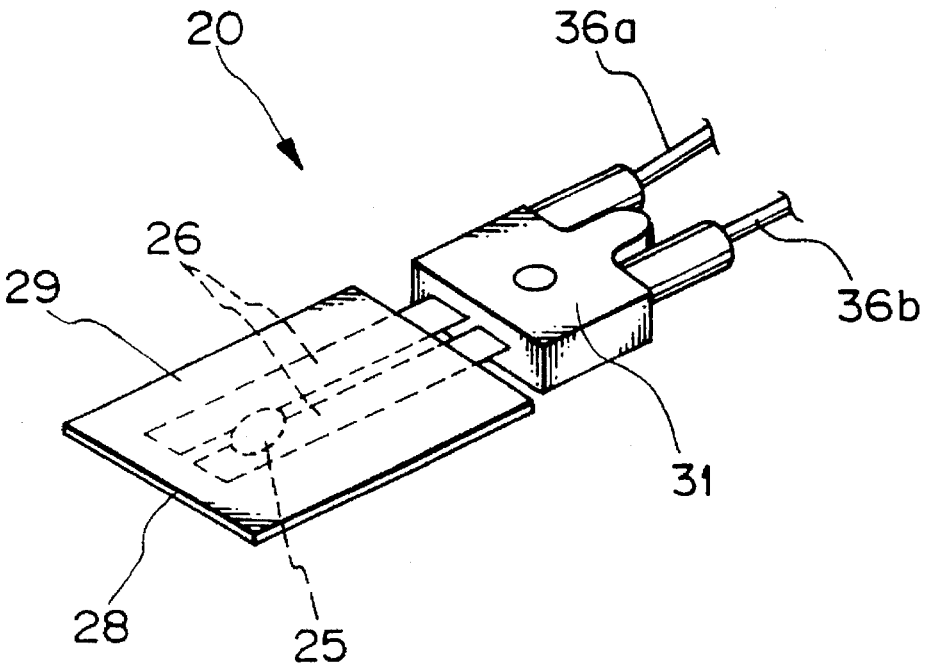
FIG. 4 is a perspective view of the temperature sensor.
Figure 5:
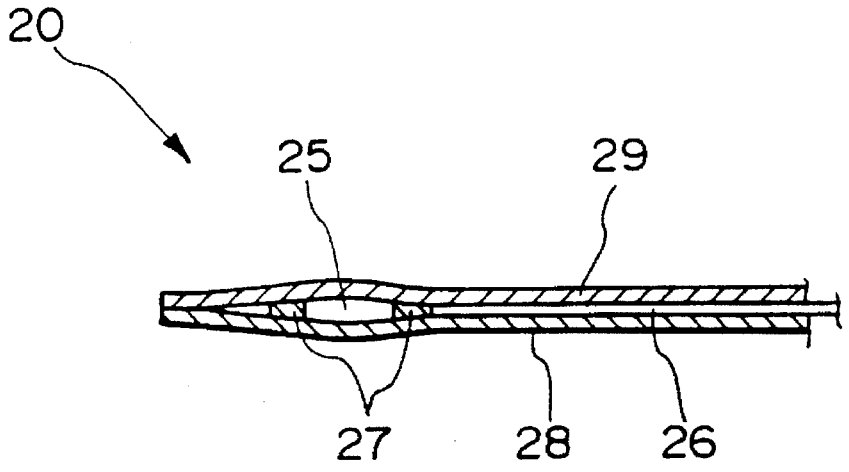
FIG. 5 is a cross-sectional view of the temperature sensor.

As shown in FIGS. 4 and 5, the temperature sensor 20 has two parallel conductive leaf springs 26. The sensing element 25 is held between the free end portions of the springs 26 and temporarily affixed thereto by silicone grease 27. As also shown in FIG. 5, an about 10 μm thick film 28 and a film 29 of substantially the same thickness as the film 28 are adhered to each other with the intermediary of the springs 26; the latter lies above the former. The film 28 is made of, for example, polyimide amide while the film 29 is made of, for example, fluorine-contained resin (Teflon), The sensing element 25 contacts the surface of the charge roller 2 via the film 28 and changes the resistance thereof in association with temperature. Since the film 28 contacts the surface of the charge roller 2, it should preferably have the same hardness as the surface of the charge roller 2 so as not to roughen it or cause irregular charging to occur.

As shown in FIG. 4, the springs 26 are spaced apart from each other and affixed at one end thereof to an insulating member 31 made of resin. The springs 24 are respectively connected to leads 36*a* and 36*b* in the insulating member 31. As shown in FIGS. 2 and 3, the insulating member 31 is affixed to a bracket 32. The bracket 32 is rotatable about a shaft 33 in a direction indicated by a double-headed arrow B in FIG. 2. A torsion spring 35 is wound round the shaft 33 to constantly bias the springs 26 toward the charge roller 5. The angular movement of the springs 26 is limited when the lower edge of the bracket 32 abuts against a stop 34.

The bracket 32 includes a lever portion 32*a*. A moving mechanism 40 includes a release lever 23 having an actuating end which is engageable with the lever portion 32*a*. The moving means 40 selectively moves the sensing element 25 of the temperature sensor 20 to a contact position shown in FIG. 2 via the film member 28 illustrated in FIG. 5, or to a separation or non-contact position shown in FIG. 3. In the contact operative position, the sensing element 25 contacts the surface of the charge roller 2. In the moving mechanism 40, the release lever 23 is formed with a slot 23*b* in which a stepped screw 41 is received, so that it is movable in the right-and-left direction as, viewed in, FIG. 3. The release lever 23 is constantly pulled to the right, as viewed in FIG. 3, by a tension spring 43. A solenoid 45 moves the release lever to the left, as viewed in FIG. 3, against the action of the tension spring 43 when energized.

FIG. 6 illustrates the bias voltage which should be applied to the charge roller, depending on the roller surface temperature. As FIG. 6 demonstrates, in order to determine the proper bias voltage to be applied to the charge roller, it is desirable to know the roller surface temperature. This figure is for a roller made of epichorohydrin rubber.

As shown in the timing diagram FIG. 7, the voltage controller 22 is so controlled by the microcomputer 50 as not to apply a voltage from the power source 24 to the charge roller 2 when the temperature sensor 20 is held in the contact position (solenoid 45 on). When a print start key 51 provided on an operation panel, not shown, is pressed to start an image forming operation, the microcomputer 50 receives a print signal from the key 51. Although not shown in FIG. 2, keys are also arranged on the operation panel for allowing the operator to select a desired paper size, image density and other image forming conditions. Signals from these keys are also applied to the microcomputer 80. The microcomputer 50 sends a drive signal to a driveline for driving the drum 1, and sends a signal to the solenoid 45 for moving the temperature sensor 20 to the separation or non-contact position.

Specifically, as shown in FIG. 7, on receiving a print signal from the print start key 51, the microcomputer 50 energizes, before applying the bias voltage to the charge roller 2, the solenoid 45 after the elapse of a period of time t1. In response, the solenoid 45 pulls the release lever 23 from the position shown in FIG. 2 to the position shown in FIG. 3 against the action of the tension spring 43. As a result, the actuating end 23*a* of the release lever 23 abuts against the lever portion 32*a* of the bracket 32 and urges it to the left, as viewed in FIG. 3, thereby causing the bracket 32 to rotate counterclockwise about the shaft 33. Hence, the temperature sensor 20 mounted on the bracket 32 is rotated in the same direction as the bracket 32. Consequently, the sensing element 25 affixed to the leaf springs 26 is moved away from the charge roller 2, as illustrated in FIG. 3.

On the elapse of a period of time t2, since the turn-on of the solenoid 45, the driveline associated with the drum 1 is driven to rotate the drum 1 in the direction A, as shown in FIG. 3. The drum 1, in turn, rotates the charge roller 2, contacting the drum surface 1*a*, in a direction indicated by an arrow C.

Further, after a period of time t3 (longer than t2) has expired since the turn-on of the solenoid 45, the power source 24, applies a bias voltage to the charge roller 2. When a period of time t4 expires after the end of the voltage application to the charge roller 2, the solenoid 45 is turned off and the sensor moves back to the contact position. During the period t5, the copying machine is idle.

While not illustrated in FIG. 7, if a series of consecutive copies are made, for example making a plurality of copies of a single page or making consecutive copies of different pages of a document through the use of an automatic document feeder, the solenoid 45 is kept on so that the temperature sensor 20 remains separated from the charge roller until all copies are made. When not contacting the charge roller 2, the temperature sensor 20 detects the air temperature around the charge roller 2.

As long as the solenoid 45 is not turned off and maintains the temperature sensor 20 in the contact position, no voltages are applied from the power source 24 to the charge roller 2. That is, a voltage is applied to the charge roller 2 only when the solenoid 45 is turned on to hold the sensor 20 in the separation position shown in FIG. 3. In this condition, the high voltage applied to the charge roller 2 does not electrically affect the sensor 20 at all since the sensor 20 is remote from the charge roller 2. Moreover, the apparatus is free from malfunctions since electric noise is prevented from entering the control system via the sensor 20 and since the circuitry is free from short-circuiting due to a small breakdown voltage.

The sensor 20 shown in FIGS. 4 and 5 has the sensing element 25 thereof contacting the charge roller 2 via the insulative film 28, thereby reducing frictional resistance between it and the roller 2 and insulating the temperature sensor 20 from the charging roller 2. Since the sensing element 25 is not more than about 10 μm thick in consideration of response, it may not have a sufficient breakdown voltage against the high voltage to be applied to the charge roller 2. However, this problem is eliminated since the sensor 20 is spaced apart from the charge roller 2 in the event of application of a high voltage to the charge roller 2.

While a voltage is applied to the charge roller 2, the sensor 20 is spaced apart from the charge roller 2, as stated above. Hence, since the surface of the charge roller 2 is not rubbed by the sensor 20, it does not wear and prevents toner and impurities, including paper dust, from adhering thereto. In addition, noise attributable to rubbing is obviated.

The bias voltage applied to the charge roller 2 is corrected according to the surface temperature of the charge roller 2 sensed by the sensor 20, as stated previously. The Correction may be effected in accordance with a specific relation between the surface temperature of the charge roller 22 and the bias voltage shown in FIG. 6.

As stated above, the illustrative embodiment controls the bias voltage to be applied to the charge roller 2 on the basis of the surface temperature of the charge roller 2 sensed by the sensor 20. Hence, even when the apparatus is used in a relatively low temperature atmosphere (e.g., lower than 25° C.), defective charging and, therefore, defective images, including low density images, are eliminated.

Figure 8:
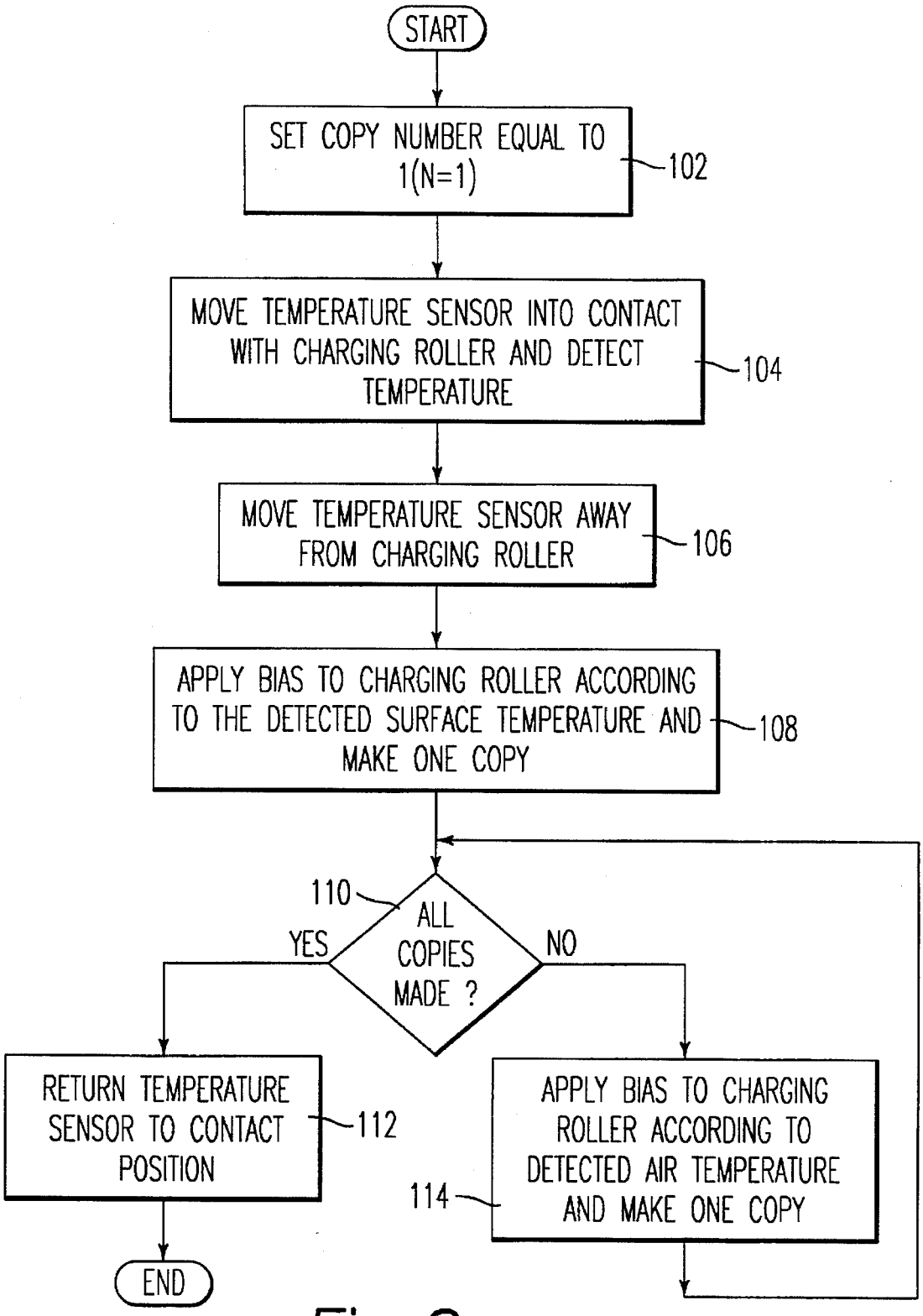
FIG. 8 is a flowchart illustrating the operation of the invention.

FIG. 8 illustrates a flowchart of the operation of the invention. After starting, step 102 sets the copy number equal to 1. This step is used to indicate that the copy being made is the first copy after the start button is pressed. Next, step 104 moves the temperature sensor 20 into contact with the charge roller 2 and measures the surface temperature of the charge roller 2. Step 106 then moves the temperature sensor 20 away from the charge roller. Subsequently, step 108 applies a bias voltage to the charging roller in accordance with the detected surface temperature of the charging roller and one copy is made.

Step 110 determines if all copies have been made. For example, if an automatic document feeder detects that more pages of a document need to be copied or if more than one copy of a page is desired by the operator, all copies have not been made and flow proceeds to step 112. In step 112, a bias voltage is applied to the charging roller according to the detected air temperature surrounding the charging roller detected by the temperature sensor 20 and another copy is made. Flow returns back to step 110.

After step 110 determined that all desired copies have been made, the temperature sensor is returned to the position which contacts the surface of the charge roller 2 and the process ends.

When successive copies are being made, it may not be possible to bring the temperature sensor 20 into contact with the charge roller 2 due to the voltage being applied to the charge roller and/or the movement of the charge roller. However, the temperature of the charge roller may change as copies are being made and therefore, it is still desirable to know the temperature of the charge roller in order to apply the proper voltage bias to the charge roller. The air temperature surrounding the charge roller to during the copy operation is a good indicator of the surface temperature of the charge roller 2.

As an alternative to step 102, it may be possible simply to sense the temperature in the contact position before the bias voltage is applied to the charge roller, and then move the temperature sensor to the separation position immediately before the charge roller bias is applied until all copies are made.

Figure 9:
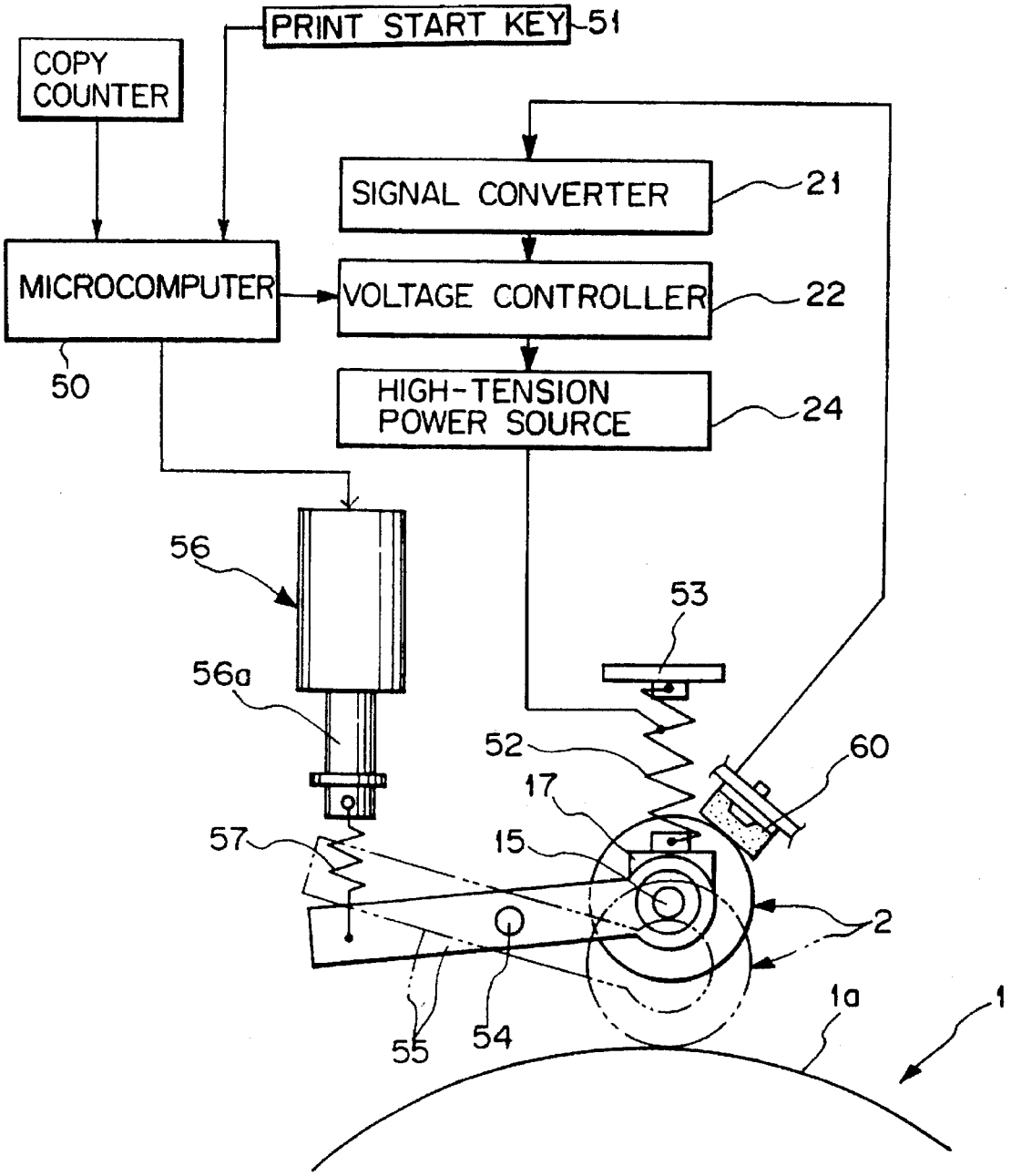
FIG. 9 shows an alternative mechanism for moving the charge roller into and out of contact with the photoconductive element.

FIG. 9 shows an alternative embodiment of a mechanism for moving the charge roller 2 toward and away from the drum 1. As shown, the core 15 of the charge roller 2 is rotatably supported by the bearings 17 which are, in turn, constantly biased away from the drum 1 by respective tension springs S2 made of a conductive material. While charging is not affected, the charge roller 2 is held in an inoperative or separation position indicated by a solid line in FIG. 9. In the figure, the reference numeral 53 designates a stationary spring retainer to which one end of the spring 52 is anchored. When the charge roller 2 is in contact with the drum surface 1*a*, a bias voltage is applied from the power source 24 to the core 15 of the roller 2 via the conductive spring 52 and conductive bearings 17. As a result, the charge roller 2 charges the drum surface 1*a* uniformly.

An arm 55 is rotatably supported by a shaft 54 at substantially the intermediate point thereof. The charge roller 2 is rotatably supported by one end of the arm 55 via the conductive bearings 17. A solenoid 56 has a plunger 56*a* which is connected to the other end of the arm 55 via a spring 57. The solenoid 56 is affixed to a stationary part of the apparatus. When the solenoid 56 is not energized, the arm 55 remains in a position indicated by a solid line in FIG. 9, due to the action of the spring 57 which maintains the charge roller 2 spaced apart from the drum 1. When the solenoid 56 is energized, the arm 55 is rotated clockwise against the action of the spring 52 to a position indicated by a phantom line in the figure. At this instant, the spring 57 is slightly stretched to allow the charge roller 2 to contact the drum surface 1*a* under a pressure adequate for charging.

The temperature sensor 60 responsive to the surface temperature of the charge roller 2 is located in the vicinity of the charge roller 2, for example 3 mm away. The sensor 60 is fixed at a position where it contacts the surface of the charge roller 2 when the roller 2 is spaced apart from the drum 1 or does not contact it when the roller 2 is held in contact with the drum 1. In this embodiment, it is the movement of the roller 2 away from the drum 1 which causes the roller 2 to contact the sensor 60.

Figure 10:
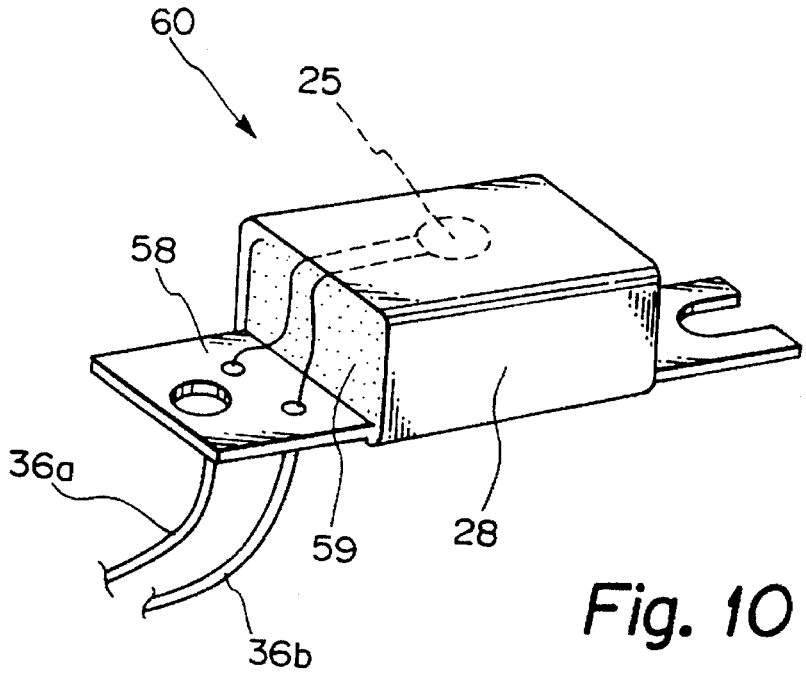
FIGS. 10 and 11 are respectively a perspective and a sectional view showing an alternative temperature sensor which may be used in the embodiment illustrated in FIG. 9.
Figure 11:
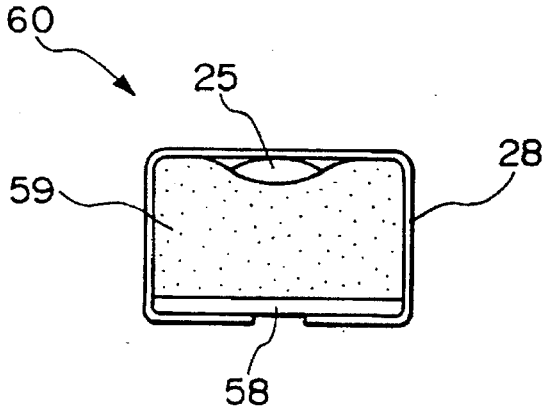

As shown in FIGS. 10 and 11, the sensor 60 has a base 58 made of, for example, epoxy resin, and a cushion 59 of foam polyurethane laid on the base 58. The sensing element 25 is positioned at substantially the center of the upper surface of the cushion 59. An about 10 μm thick film 28 is made of polyimide amide and covers the sensor assembly from above the temperature sensing element 25. The film 28 plays the same role as the film 28 of the sensor 20 shown in FIGS. 4 and 5.

The process performed with respect to the mechanism illustrated in FIG. 9 is similar to the process illustrated in FIG. 8. However, in addition to what is described with respect to FIG. 8, step 104, while moving the temperature sensor into contact with the charging roller moves the charging roller away from the drum 1. Similarly, step 106 also moves the charging roller 2 against the drum 1, and step 114 moves the charging roller 2 away from the drum 1 against the temperature sensor 60.

Figure 12:
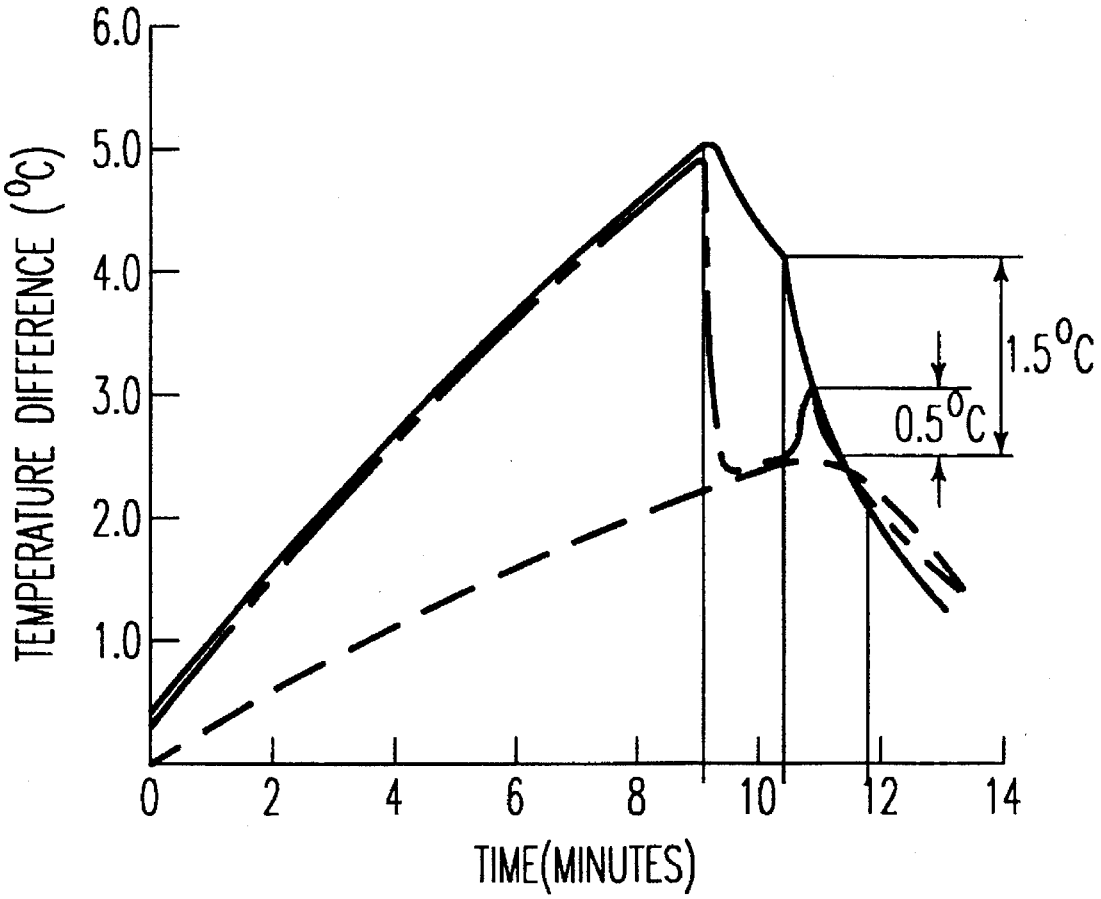
FIG. 12 illustrates various temperature differences which exist when a jam occurs when forming an image; and the temperature differences after the jam is corrected.

An explanation of the advantages achieved by the present invention is given with respect to the temperature differences illustrated in FIG. 12. An experiment was conducted to determine the effectiveness of the invention. The experiment was conducted on an analog copying machine having a paper travel speed of 200 mm/sec., a copy speed of 35 sheets/minute (A4 size), the copying machine using a charging roller made of epichlorohydrin rubber having a thickness of 3 mm, using a thermistor to detect the charge roller temperature and the air temperature surrounding the charge roller, the thermistor having a thermal time constant of 10 seconds, and the distance between the charge roller and the thermistor in the non-contact or separation position being 3 mm.

FIG. 12 illustrates the elapsed time of a copying operation when a paper jam occurs at time zero minutes, at which the front cover of the machine is opened. The front cover of the copy machine is opened at time 9 minutes, the copy machine restarts the previous copy job after the fixing rollers have returned to the necessary fixing temperature at time 10.5 minutes, and a new copy job starts at time 11.5 minutes.

In FIG. 12, the temperature of the air surrounding the charge roller is illustrated with a solid line, the surface temperature of the charge roller is illustrated as a dashed line, and the temperature detected by the temperature sensor is illustrated as a line containing both dashes and dots.

At time zero minutes, a jam occurs in the copying machine and the door of the copying machine is opened. At this time, the difference between the temperature detested by the temperature sensor, indicated by the line containing the dashes and dots, and the atmosphere temperature, indicated by the solid line, is essentially zero. This is because during the copying operation, the temperature sensor detects the air temperature surrounding the roller, The actual surface temperature of the roller at time zero is 0.5° C. less than the temperature detected by the temperature sensor which is the temperature of the air 3 mm away from the roller surface.

After time zero, the fan to circulate air and cool the fixing device stops and accordingly, the air temperature within the copier rises faster than the temperature of the charging roller, as evidenced by the increasing distance between the dashed line and the solid line between time 0 seconds and time 9 seconds.

At the time of 9 minutes, the door of the copier is closed as the jam has been cleared and the charge roller no longer contacts the photoconductor but contacts the temperature sensor. Accordingly, the temperature detected by the temperature sensor, as indicated by the dashed and dotted line, quickly falls from the atmosphere temperature to the surface temperature of the charge roller between the times 9 and 9.5 minutes. After 9 minutes, the fan of the fixing device also begins to operate and therefore, the air temperature surrounding the charging rollers begins to gradually decline.

At time 10.5 minutes, the temperature of the fixing device returns to its operating temperature and the copy operation is restarted. During this time after 10.5 minutes, the fan of the fixing device operates more rapidly than during the stand-by time from 9 to 10.5 minutes and accordingly, the air temperature surrounding the charge roller 2 decreases more rapidly after 10.5 minutes.

Once the copy operation restarts after 10.5 minutes, the temperature sensor no longer contacts the charge roller but moves to 3 mm away from the charge roller and detects the air temperature surrounding the charge roller. At this time, the air temperature within the copier has rapidly descended and the difference between the air temperature and the charge roller surface temperature is small, usually no more than 0.5°, as illustrated in the Figure. Therefore, when the copier is operating, it is acceptable to detect the air temperature surrounding the charge roller. However, before the copy operation begins (at 10.5 minutes), the air temperature surrounding the roller is about 1.5° C. greater than the surface temperature of the roller which may be an unacceptable error in the detected temperature because an improper charging bias voltage may be applied to the charge roller 2.

From the above description of FIG. 12, it is seen that under certain circumstances, it is important to detect the actual surface temperature of the charge roller, and in other circumstances, it is acceptable to detect the air temperature surrounding the charge roller. The present invention operates in order to achieve accurate temperature detecting results.

In addition to the temperature difference between roller and the air surrounding the roller increasing after a jam occurs, the difference between the temperatures also increases after the copy machine has been stopped for a long time, or possibly after copying continues with a large number of copies. The present invention allows an accurate temperature reading of the surface temperature of the charging roller under specific circumstances, for example when the charge roller is stopped, and provides a good estimate of the temperature of the charge roller by detecting the air temperature surrounding the charge roller, when the actual surface temperature of the charge roller cannot be detected. This results in an accurate controlling of the voltage applied to the charge roller.

While the embodiments shown and described have used a thermistor as a temperature sensing means, it may be replaced with any other suitable temperature sensing means so long as it can transform temperature to an electric signal. For example, use may be made of a thermocouple, a resistor having platinum as a resistance element whose electric resistance changes with a change in temperature, or an IC (Integrated Circuit) sensor having a temperature coefficient of about 2.3 mV/°C. particular to the base-emitter forward voltage drop of a bipolar transistor and having an amplifier and output transistor packaged on a single silicon chip.

Figure 13A:
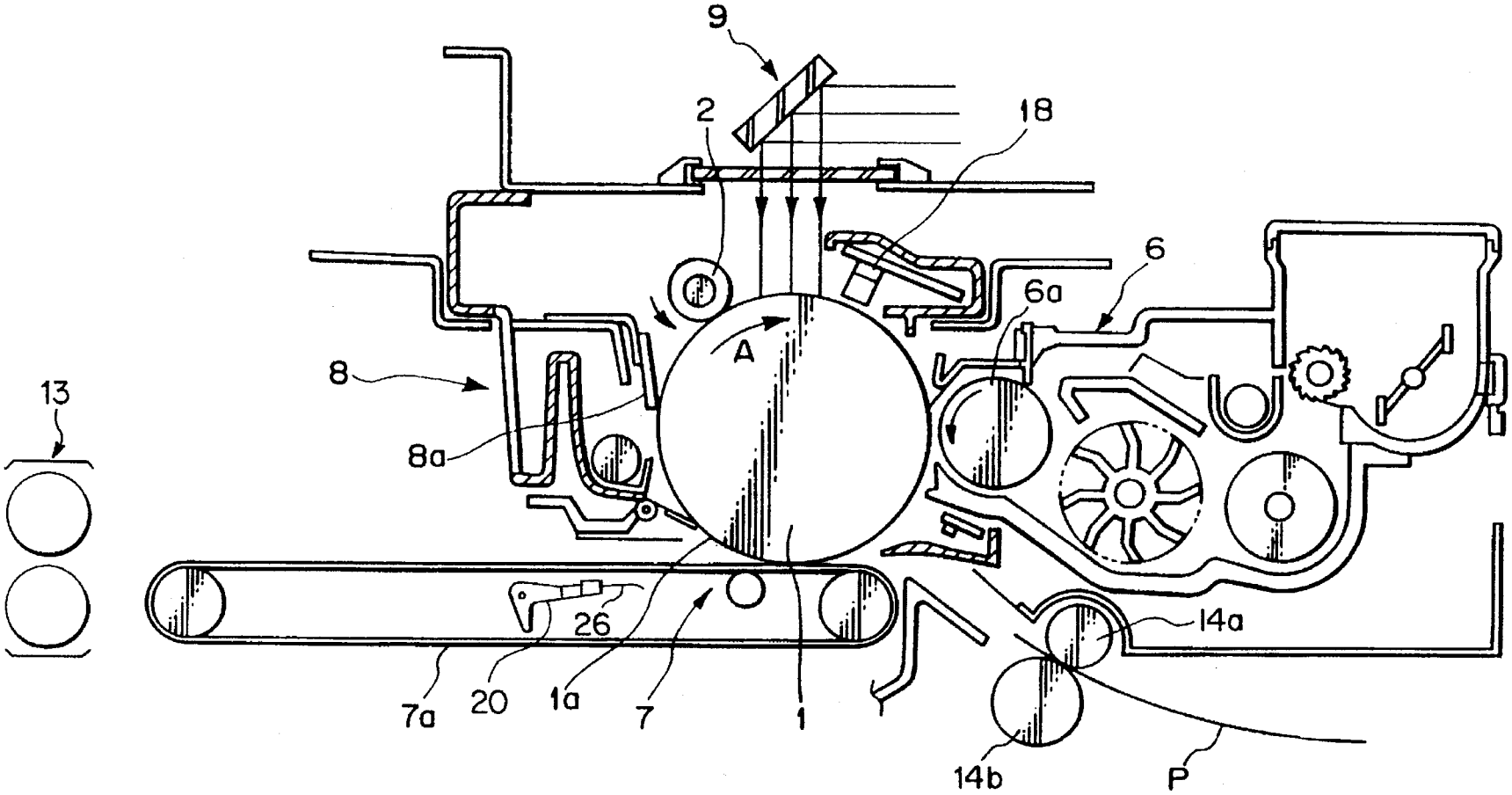
FIG. 13A illustrates the invention utilized with a transfer belt.
Figure 13B:
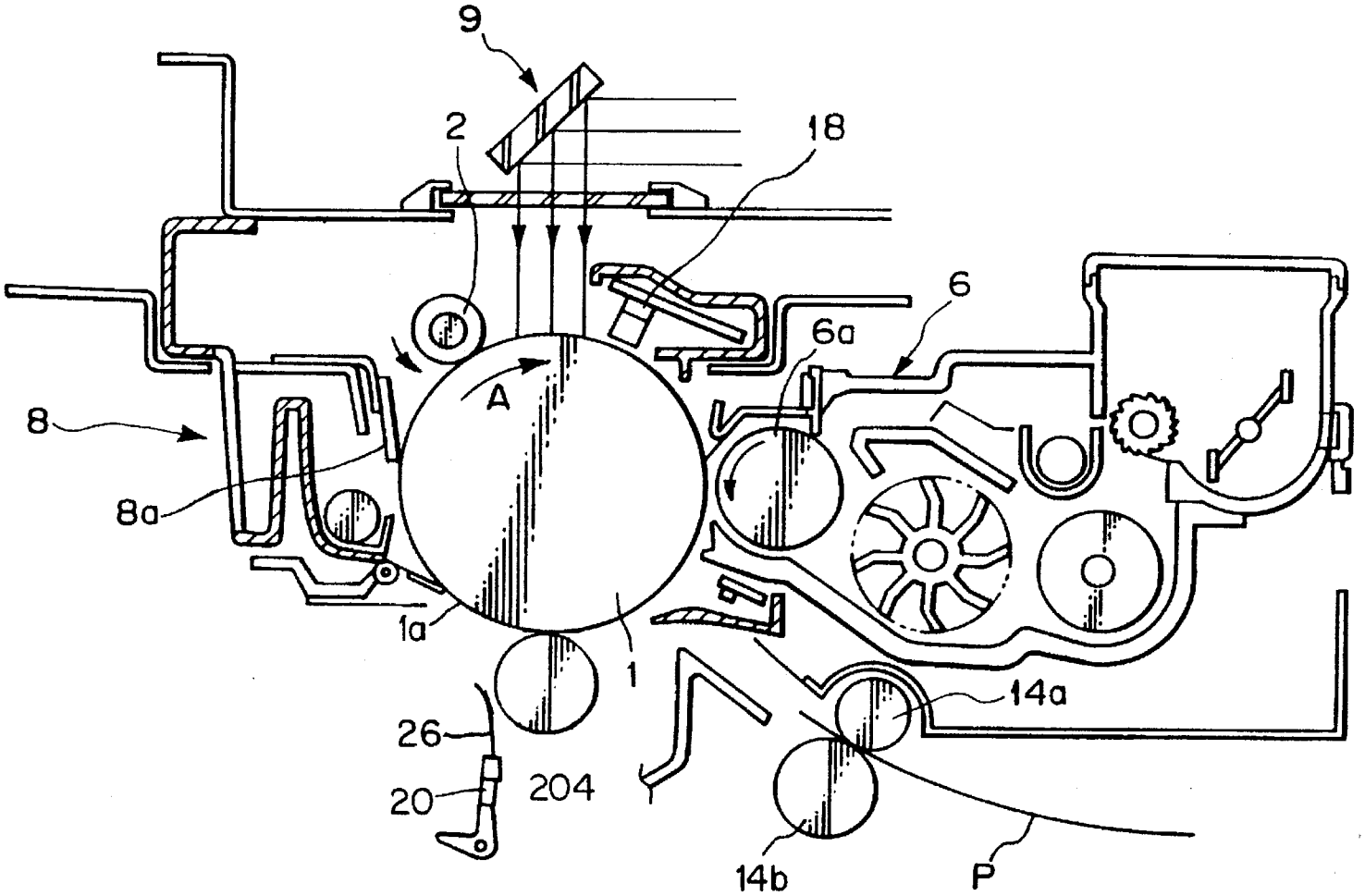
FIG. 13B illustrates the invention utilized with a transfer roller.

In the illustrated embodiments, the member to have the surface temperature thereof sensed in contact with a photoconductive element has been a charge roller. However, the teaching herein may also be supplied to an image transfer member contacting the photoconductive element as illustrated in FIG. 13A. Alternatively, the transfer belt shown in FIGS. 1 and 9 may be replaced with a transfer roller 204, as illustrated in FIG. 13B. If an arrangement is made Such that a voltage to be applied to the transfer member is controlled in response to the output of a temperature sensor responsive to the surface temperature of the transfer member, it is possible to transfer a toner image from the photoconductive element to a sheet in optimal conditions at all times without regard to the temperature around the apparatus.

Figure 14:
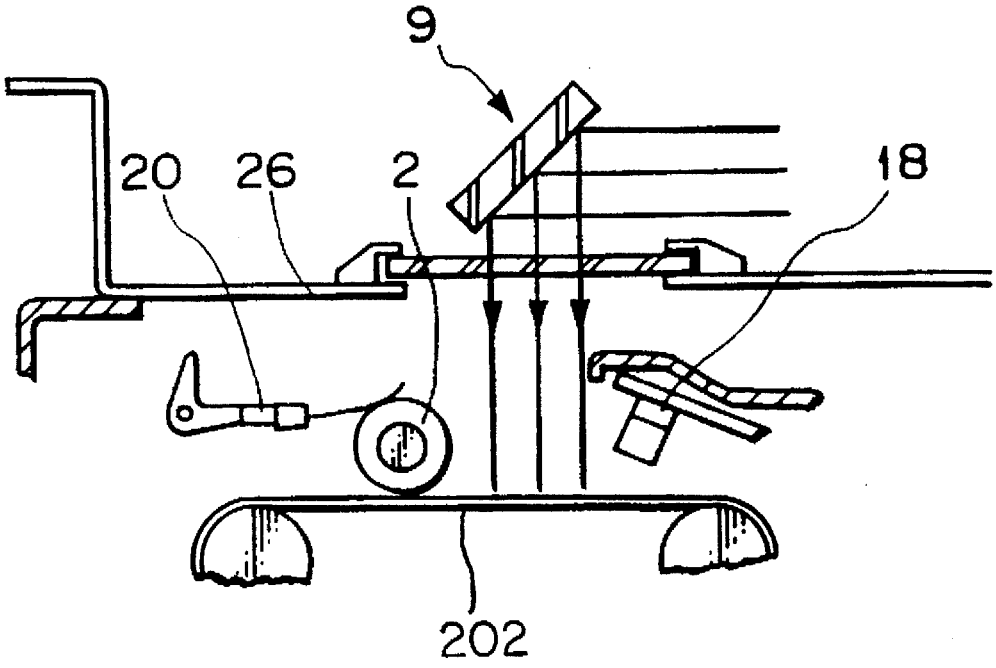
FIG. 14 illustrates the photoconductive drum of FIG. 1 replaced with a photoconductive belt.

When the member to which the embodiments pertain is implemented as a charging member, the charging member may be comprised of a belt, blade or brush in place of a roller. Even the photoconductive element may be implemented as a belt 202, if desired, as illustrated in FIG. 14.

While the embodiments have concentrated on a temperature sensor, the image forming process is susceptible not only to temperature but also to, for example, humidity. Hence, a humidity sensor or similar sensor may be used in combination with or in place of the temperature sensor.

The present invention uses one or more microcomputers or control boards to perform the above-described functions. These microcomputers or control boards may be implemented using conventional microprocessors or a conventional general purpose digital computer programmed according to the teachings of the present application, as will be appropriate to those skilled in the art. Appropriate software coding can readily be prepared by skilled programmers based on the teachings of the present disclosure, as will be apparent to those skilled in the software art. The invention may also be implemented by the preparation of applications specific integrated circuits or by interconnecting an appropriate network of conventional component circuits, as will be readily apparent to those skilled in the art.

Obviously, numerous modifications and variations of the present invention are possible in light of the above teachings. It is therefore to be understood that within the scope of the appended claims, the invention may be practiced otherwise than as specifically described herein.

What is claimed and desired to be secured by Letters Patent of the United States is:

1. An apparatus comprising:

a photoconductive element;

a contact member in contact with the photoconductive element;

a voltage source for supplying a voltage to the contact member;

a temperature sensor which contacts the contact member when the temperature sensor is in a first position relative to the contact member, and is separated from the contact member when in a second position relative to the contact member, the temperature sensor having an output corresponding to a sensed temperature; and control means for controlling the voltage from the voltage source in response to the output of the temperature sensor when the temperature sensor is in the first and second positions.

2. An apparatus as claimed in claim 1, wherein the control means controls the voltage source such that the voltage source does not apply the voltage to the contact member when the temperature sensor is in the first position.

3. An apparatus according to claim 1, wherein the contact member is a charge roller.

4. An apparatus according to claim 3, wherein the photoconductive element is a photoconductive drum.

5. An apparatus according to claim 3, wherein the photoconductive element is a photoconductive belt.

6. An apparatus according to claim 1, wherein the contact member is one of a transfer roller and transfer belt.

7. An apparatus according to claim 1, further comprising:

a moving means which moves the temperature sensor relative to the contact member between the first and second positions.

8. An apparatus according to claim 7, wherein the moving means moves the temperature sensor.

9. An apparatus according to claim 8, wherein the moving means operates without affecting a position of the contact member, relative to the photoconductive element.

10. An apparatus according to claim 7, wherein the moving means moves the contact member.

11. An apparatus according to claim 10, wherein the moving means further includes:

means for moving the contact member in a position separated from the temperature sensor such that when the contact member is separated from the temperature sensor and the temperature sensor is in the second position relative to the contact member, the contact member is in contact with the photoconductive element, and means for moving the contact member in a position contacting the temperature sensor such that when the contact member is contacting the temperature sensor and the temperature sensor is in the first position relative to the contact member, the contact member is separated from the photoconductive element.

12. A method for moving a temperature sensor relative to a contact member which contacts a photoconductive element and is supplied with a voltage, comprising the steps of:

sensing a temperature of a surface of the contact member using the temperature sensor;

determining a first voltage to be applied to the contact member using the sensed temperature of the surface of the contact member;

applying the first voltage to the contact member;

moving the temperature sensor, relative to the contact member, away from the surface of the contact member;

sensing a temperature of air surrounding the surface of the contact member using the temperature sensor;

determining a second voltage to be applied to the contact member using the sensed temperature of the air surrounding the surface of the contact member; and applying the second voltage to the contact member.

13. A method according to claim 12, wherein when the step of sensing the temperature of the surface of the contact member is being performed, no voltage is being applied to the contact member.

14. A method according to claim 12, wherein the moving step includes:

moving the temperature sensor.

15. A method according to claim 14, wherein the moving step is performing without moving a position of the contact member, relative to the photoconductive element.

16. A method according to claim 15, wherein the moving step includes:

moving the contact member.

17. A method according to claim 16, wherein the moving step moves the contact member to a position at which the contact member does not contact the photoconductive element.

18. An apparatus comprising:

a photoconductive element;

a voltage applying means for applying a voltage to the photoconductive element, when the voltage applying means contacts the photoconductive element;

a voltage source for supplying the voltage to the voltage applying means;

a temperature sensor which contacts the voltage applying means when the temperature sensor is in a first position relative to the voltage applying means, and is separated from the voltage applying means when in a second position relative to the voltage applying means, the temperature sensor having an output corresponding to a sensed temperature; and control means for controlling the voltage from the voltage source in response to the output of the temperature sensor when the temperature sensor is in the first and second positions.

19. An apparatus according to claim 18, further comprising:

a moving means which moves the temperature sensor relative to the voltage applying means between the first and second positions.

20. An apparatus as claimed in claim 18, wherein the control means controls the voltage source such that the voltage source does not supply the voltage to the voltage applying means when the temperature sensor is in the first position.

* * * * *